US008797008B2

(12) United States Patent
Devegowda

(10) Patent No.: US 8,797,008 B2
(45) Date of Patent: Aug. 5, 2014

(54) LOW-DROPOUT REGULATOR OVERSHOOT CONTROL

(75) Inventor: Sachin Devegowda, Munich (DE)

(73) Assignee: Infineon Technologies AG, Neubiberg (DE)

( * ) Notice: Subject to any disclaimer, the term of this patent is extended or adjusted under 35 U.S.C. 154(b) by 76 days.

(21) Appl. No.: 13/344,890

(22) Filed: Jan. 6, 2012

(65) Prior Publication Data

US 2013/0176007 A1 Jul. 11, 2013

(51) Int. Cl.

| | |
|---|---|
| ***G05F 1/56*** | (2006.01) |
| *G05F 1/565* | (2006.01) |
| *G05F 1/575* | (2006.01) |

(52) U.S. Cl.

USPC ..... 323/274; 323/275; 323/278

(58) Field of Classification Search

USPC ..... 323/273–281

See application file for complete search history.

(56) References Cited

U.S. PATENT DOCUMENTS

| | | | | |
|---|---|---|---|---|
| 4,437,146 | A * | 3/1984 | Carpenter | 323/222 |
| 4,724,375 | A * | 2/1988 | Dittmar | 323/275 |
| 5,221,887 | A * | 6/1993 | Gulczynski | 323/285 |
| 5,467,009 | A * | 11/1995 | McGlinchey | 323/269 |
| 5,559,424 | A * | 9/1996 | Wrathall et al. | 323/277 |
| 6,671,143 | B2 * | 12/2003 | Hwang | 361/18 |
| 7,443,148 | B2 * | 10/2008 | Weng | 323/271 |
| 8,115,463 | B2 * | 2/2012 | Wang | 323/280 |
| 2008/0088292 | A1 * | 4/2008 | Stoichita et al. | 323/285 |
| 2012/0013317 | A1 * | 1/2012 | Morino | 323/280 |

* cited by examiner

*Primary Examiner* — Adolf Berhane
*Assistant Examiner* — Nusrat Quddus
(74) *Attorney, Agent, or Firm* — SpryIP, LLC

(57) ABSTRACT

Representative implementations of devices and techniques control regulator output overshoot. An offset signal is provided to a component of the regulator during at least a portion of the regulator start-up.

22 Claims, 5 Drawing Sheets

LOW-DROPOUT REGULATOR OVERSHOOT CONTROL

BACKGROUND

Various mobile or portable electronic devices may have reduced power consumption by operating some of the systems within these devices at low voltages (e.g., 3.0 volts, 1.5 volts, etc.). A power management unit within such devices can convert an input voltage to several supply domains with different output voltages and requirements. For example a digital block might need voltage scaling capability, whereas analog parts may each need a different supply voltage. Such devices or systems can easily end up with many different supply domains.

The power conversion between input and output voltage is often done with low-dropout regulators (LDOs). LDOs can generally operate efficiently at low voltages and can provide a regulated output using small differential input-output voltages. A regulated output from a LDO is commonly based on a comparison of a feedback signal from the output of the regulator to a reference voltage.

However, output voltage overshoot can occur on start-up of a LDO. Overshoot is defined as the peak voltage above a nominal voltage for any step input at the LDO. Higher overshoot voltages can compromise the reliability of a circuit coupled to the output of a LDO, if not cause destruction of the circuit. For example, voltage overshoot can commonly be at least 100 mV over nominal on LDO start-up.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Representative implementations of devices and techniques control regulator output overshoot. In various implementations, an offset signal is provided to a component of the regulator during at least a portion of the regulator start-up, thereby reducing, if not eliminating, the overshoot. For example, in one implementation, a voltage offset is added to a feedback voltage at an input to the voltage regulator at commencement of start-up. The offset is subsequently removed when the feedback voltage reaches a preset minimum common mode potential (i.e., the regulator feedback circuit is charged to a preset threshold loop gain).

In some implementations, the offset signal is provided by a circuit coupled to the voltage regulator, as in a system. In other implementations, the offset circuit is integral to the voltage regulator. The offset may be controlled by a timing device, a switch, or a combination of components associated with the offset circuit and/or the voltage regulator. In one example, the offset signal is controlled by a current limiter and is supplied to the voltage regulator based on the current limiting operation of the current limiter.

Various implementations for minimizing or eliminating regulator output overshoot, including techniques and devices, are discussed with reference to the figures. The techniques and devices discussed may be applied to any of various regulator designs, circuits, and devices and remain within the scope of the disclosure.

Advantages of the disclosed techniques and devices are varied, and include: 1) fast start-up time with little or no output overshoot; 2) an offset that is automatically and dynamically turned on and off during start-up; and 3) that no additional digital logic is needed to implement the techniques. Other advantages of the disclosed techniques may be apparent in the disclosure, based on the techniques and/or devices discussed.

Implementations are explained in more detail below using a plurality of examples. Although various implementations and examples are discussed here and below, further implementations and examples may be possible by combining the features and elements of individual implementations and examples.

Representative Regulator

Figure 1:
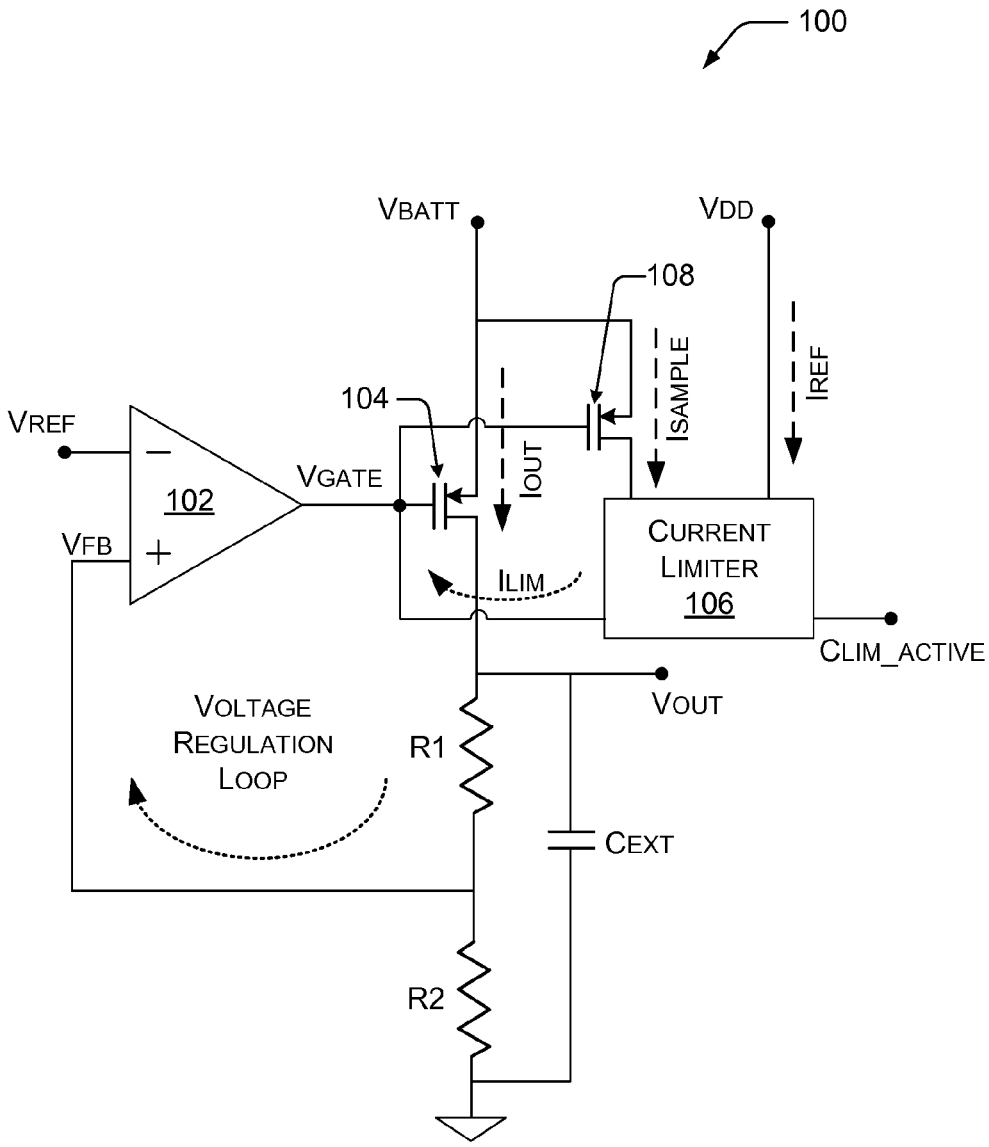
FIG. 1 is a block schematic of a representative regulator, such as a low-dropout regulator (LDO), in which the techniques in accordance with the present disclosure may be implemented.

FIG. 1 illustrates a representative low-dropout regulator (LDO) 100 in which the techniques in accordance with the present disclosure may be implemented. While the disclosure and drawings are discussed in terms of a low-dropout regulator (LDO), this is not intended as a limitation, and is for ease of discussion. The techniques and devices disclosed herein are applicable to various types of voltage and current regulators of various circuits and designs. Accordingly, the generic term "regulator" will be used hereinafter.

As shown in the illustration of FIG. 1, an example regulator 100 is powered by an input voltage $V_{BATT}$ and produces an output voltage $V_{OUT}$. The output voltage $V_{OUT}$ is regulated based on a difference between a reference voltage $V_{REF}$ and a feedback voltage $V_{FB}$. An error amplifier 102 receives $V_{REF}$ and $V_{FB}$ at differential inputs and outputs a potential $V_{GATE}$ based on a difference between the inputs. The error amplifier 102 may comprise an operational amplifier (op amp), or the like. In one implementation, the error amplifier 102 comprises an operational transconductance amplifier (OTA).

The potential $V_{GATE}$ operates a pass device 104, allowing current to pass from the input voltage $V_{BATT}$ to the output $V_{OUT}$, via a voltage divider comprising a number of resistors (e.g., R1 and R2). A feedback loop sends the output potential (or a fraction/multiple of the output potential) to one of the inputs of the error amplifier 102 as the feedback signal ($V_{FB}$). Thus, a voltage regulation loop includes the error amplifier 102, the pass device 104, one or more resistors of the voltage divider (e.g., R1 and/or R2), and a feedback path from the voltage divider (regulator output) back to the error amplifier 102 (e.g., feedback voltage $V_{FB}$).

Additionally, as shown in FIG. 1, a regulator 100 may include an output capacitor (or "external capacitor") $C_{EXT}$. The capacitor $C_{EXT}$ may provide buffering for instantaneous loads coupled to the regulator 100, may provide filtering of the output voltage $V_{OUT}$, or the like. In some cases, the output voltage $V_{OUT}$ of the regulator 100 may suffer from overshoot when the capacitor $C_{EXT}$ charges during start-up of the regulator 100.

In some examples, the regulator 100 may include a current limiter 106 arranged to determine a current flow through the regulator 100 during at least a portion of the start-up of the regulator 100. For example, the current limiter 106 may limit the current through the regulator 100 to a limited value $i_{LIM}$, as shown in FIG. 1. The current limiter 106 may receive a sample current $i_{SAMPLE}$ from the source input $V_{BATT}$ as well as a reference current $i_{REF}$ to determine the current $i_{LIM}$ through the regulator 100. In one example, as illustrated in FIG. 1, the sample current $i_{SAMPLE}$ may be received at the current limiter 106 via another pass through device 108 controlled by the output voltage of the error amplifier 102. Pass through devices 104 and/or 108 may be comprised of transistors (e.g., field effect transistors (FETs), junction field effect transistors (JFETs), metal-oxide semiconductor FET transistors (MOSFETs), bipolar junction transistors (BJTs), etc.), and the like.

Figure 2:
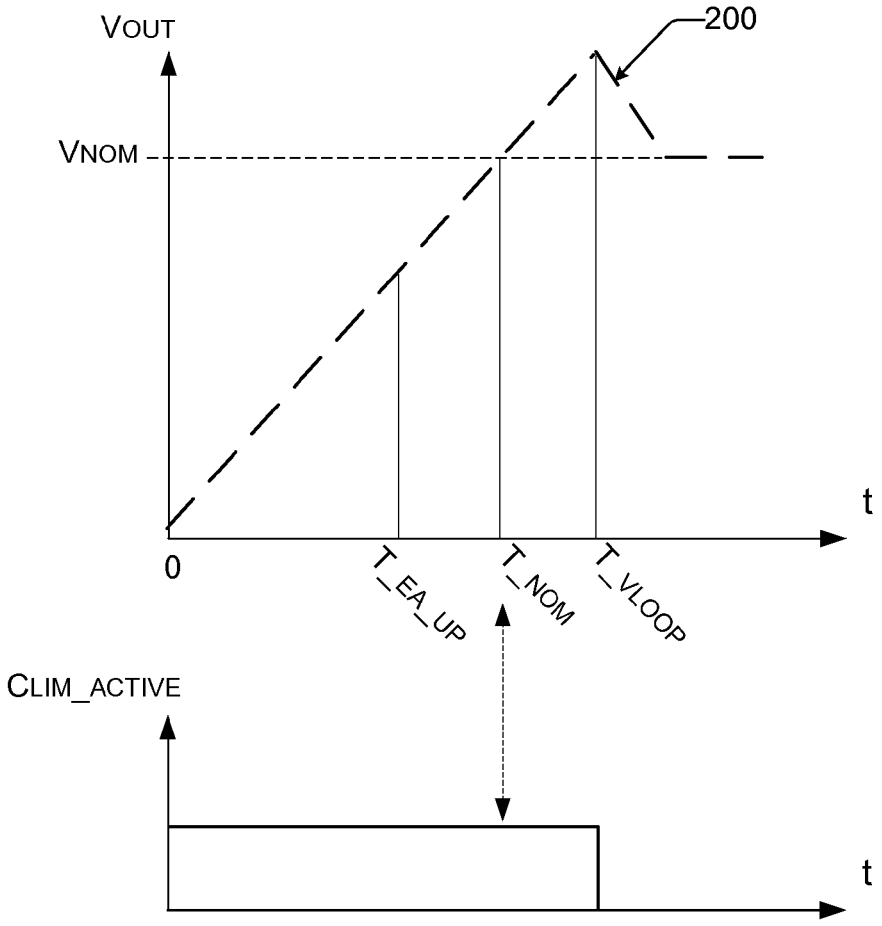
FIG. 2 is a graph showing a typical start-up response of a regulator as shown in FIG. 1.

In one implementation, the current limiter 106 may clamp the pass through device 104 to a fixed potential, thereby limiting the magnitude of the current $i_{OUT}$ which feeds the voltage divider, the regulator output $V_{OUT}$ and charges the capacitor $C_{EXT}$. Referring to FIGS. 1 and 2, for instance, during start-up of the regulator 100, the regulator output $V_{OUT}$ ramps up from ground potential, and the capacitor $C_{EXT}$ (having a value of a few micro farads, for example) sinks large instantaneous surge currents as it begins to charge. The current limiter 106 may react to the surge currents by clamping the pass through device 104 to a fixed potential (i.e., putting the regulator 100 into an over-current protection mode). The pass through device 104 becomes essentially a constant current source, supplying a current $i_{LIM}$ to charge the capacitor $C_{EXT}$ and the output node $V_{OUT}$ towards the source potential $V_{BATT}$. After a small finite time, the surge currents from the capacitor $C_{EXT}$ will generally subside.

The voltage at the output $V_{OUT}$ during start-up of the regulator 100 is shown as a curve 200 (with a heavy-dashed line) in FIG. 2. The output curve 200 is shown as a substantially linear ramp, reflecting the clamp of the pass through device 104 by the current limiter 106 during start-up of the regulator 100. The constant current $i_{LIM}$ charges the voltage regulation loop, including the error amplifier 102 (as well as the internal nodes of the error amplifier 102). For example, at startup, the error amplifier 102 takes a finite amount of time to fully turn "on." The internal nodes of the error amplifier 102 take time to charge up to their stable operating points before the error amplifier 102 can start regulating. Additionally, the voltage regulation loop takes time to achieve a minimum "loop gain." The feedback resistors (e.g., voltage divider resistors R1 and R2) and associated capacitors (e.g., $C_{EXT}$) can present additional time delays during charging.

At the commencement of start-up, as shown in the graph of FIG. 2, the voltage regulation loop is inactive, and the regulator 100 is not regulating. At the error amplifier 102, a pre-activation condition exists: the tail current source is switched off, the input transistors are switched off, and the loads are switched off. After commencement, the error amplifier 102 and the voltage regulation loop begin charging, and the output $V_{OUT}$ begins ramping up based on the current $i_{LIM}$.

At time duration T_EA_UP, the voltage regulation loop reaches a minimum loop gain. The voltage regulation loop continues to charge and the error amplifier 102 turns on. At the error amplifier 102, the tail current source is stabilized, the currents in the differential branches are stabilized, the $V_{FB}$ input reaches a minimum input common mode potential, and the load transistors are in a stable condition (e.g., gate at Vgs>Vth). Further, the currents through the two differential paths of the error amplifier 102 are substantially equal and the error amplifier 102 has a finite transconductance (gm) and is ready to amplify. Meanwhile, the output $V_{OUT}$ continues ramping up.

At the time duration T_NOM, the output $V_{OUT}$ has ramped up to the nominal operating voltage $V_{NOM}$ due to the constant current $i_{LIM}$. Generally, $T_NOM = C_{EXT} * V_{NOM} / i_{LIM}$.

Finally, at time T_VLOOP, the voltage regulation loop is fully active, based on having reached a preset threshold loop gain. With the loop gain of the voltage regulation loop large enough (e.g., a preset threshold value), the current limiter 106 ceases to clamp the pass through device 104 and the regulator 100 comes out of constant current mode and goes into voltage regulation mode.

As shown in FIG. 2, if the activation of the voltage regulation loop is too late (i.e., T_VLOOP is later than T_NOM), then $V_{OUT}$ overshoots the nominal operating voltage $V_{NOM}$ and continues to ramp up toward the source voltage $V_{BATT}$. Additional time delays may be a result of a filter in the feedback path, a bandwidth of the voltage regulation loop, and a slewing time of internal nodes of the error amplifier. Once the current limiter 106 ceases to clamp the pass through device 104, the output voltage $V_{OUT}$ falls back to a nominal voltage $V_{NOM}$ as the regulator 100 regulates the output normally.

Also shown in FIG. 2 is the current limiter 106 activation signal $C_{LIM_ACTIVE}$. This signal is shown active from the commencement of the start-up until the time duration T_VLOOP, when the voltage regulation loop has reached a preset threshold value (e.g., the voltage regulation loop is large enough for voltage regulation) and the current limiter 106 no longer limits the current through the regulator 100.

Example Implementations

Figure 3:
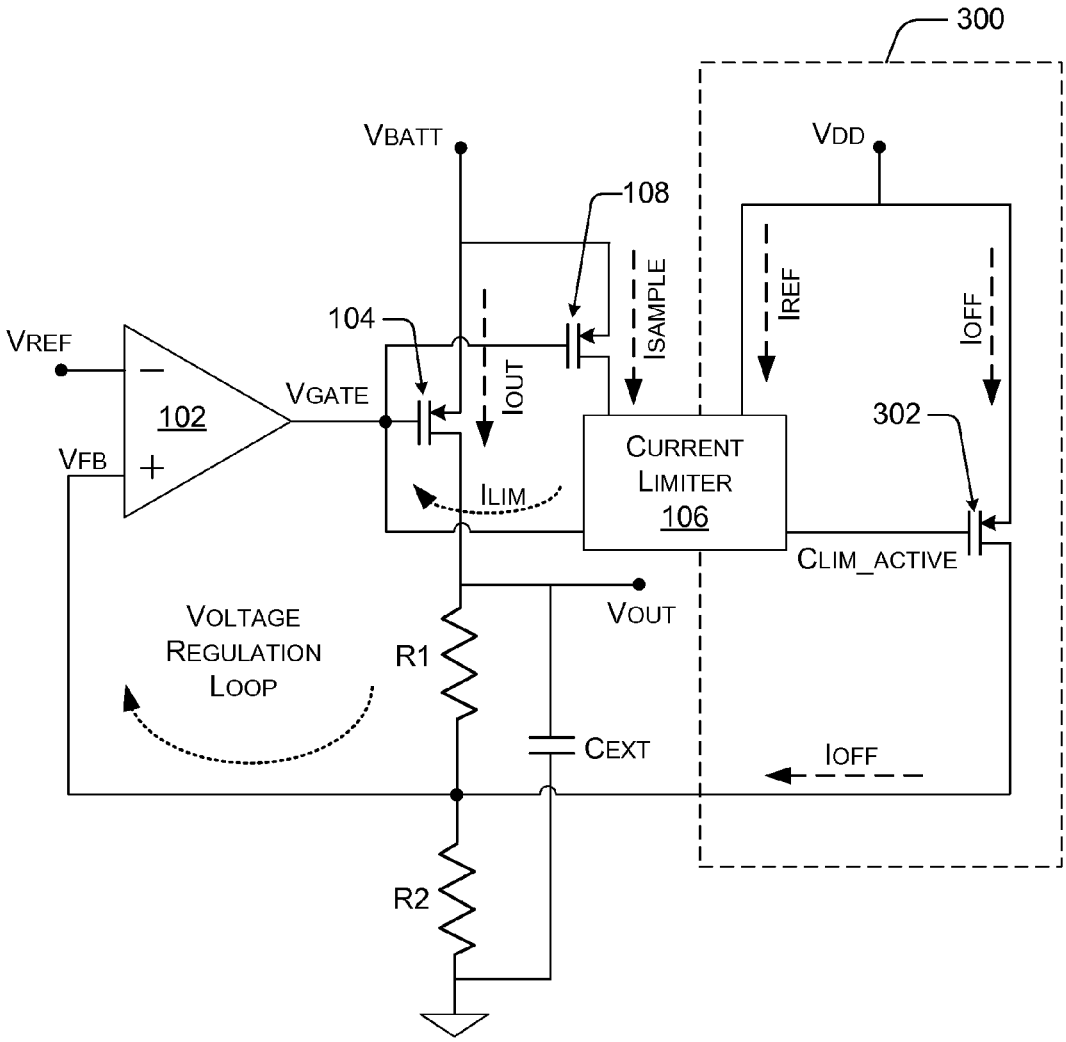
FIG. 3 is a block schematic of an exemplary regulator and an offset circuit according to an implementation.

FIG. 3 is a block schematic of an example regulator 100 and an offset circuit 300 according to an implementation. It is to be understood that an offset circuit 300 may be implemented as a separate component, coupled to a regulator 100; as an integral part of a regulator 100 circuit; or as part of a system including a regulator 100 and an offset circuit 300. The illustration of FIG. 3 is shown and described in terms of an integrated regulator 100 and offset circuit 300. This illustration is, however, for ease of discussion. The techniques and devices described herein with respect to overshoot control for regulators is not limited to the configuration shown in FIG. 3, and may be applied to other configurations without departing from the scope of the disclosure.

Various implementations of offset circuits 300, as described herein, may include fewer components and remain within the scope of the disclosure. Alternately, other implementations of offset circuits 300 may include additional components, or various combinations of the described components, and remain within the scope of the disclosure.

In general, if the voltage regulation loop has sufficient loop gain and bandwidth to trigger a handover from a current limited loop mode to a voltage regulation loop mode, there will be no voltage overshoot at the output of the regulator 100. Referring back to FIG. 2, if T_EA_UP and T_VLOOP are less than T_NOM in duration, then there will be no overshoot.

In various implementations, an offset circuit 300 adds an offset to a potential at the voltage regulation loop (e.g., adds an offset voltage to the feedback voltage $V_{FB}$) during at least a portion of the start-up of the regulator 100, thereby reducing or eliminating overshoot at the output of the regulator 100. In one implementation, the offset circuit 300 is arranged to provide an offset value to at least one of the two differential inputs of the error amplifier 102 during at least a portion of a start-up of the regulator 100. In another implementation, the offset circuit 300 is arranged to provide the offset value to the first input and/or the second input of the error amplifier 102 until the voltage regulation loop reaches a preset threshold loop gain.

In various implementations, the offset value (i.e., offset signal) may comprise an offset voltage and/or an offset current. For example, in one implementation, as shown in FIG. 3, a voltage regulation loop is coupled to a first input ($V_{FB}$) of the error amplifier 102 and a reference voltage $V_{REF}$ is coupled to the second input of the error amplifier 102. The offset circuit 300 is arranged to provide the offset value (e.g., $V_{OFF}$ and/or $i_{OFF}$) to the voltage regulation loop while a voltage at the first input ($V_{FB}$) of the error amplifier 102 is less than the reference voltage $V_{REF}$. In another example, the offset circuit 300 is arranged to combine the offset value (e.g., $V_{OFF}$ and/or $i_{OFF}$) to the reference voltage $V_{REF}$ at the second input of the error amplifier 102 while a voltage at the first input ($V_{FB}$) of the error amplifier 102 is less than a voltage at the second input ($V_{REF}$) of the error amplifier.

The addition of the offset signal has the effect of reducing T_EA_UP (i.e., the time duration for the voltage regulation loop to reach a minimum loop gain) and T_VLOOP (i.e., the time duration for the loop gain to reach a preset threshold value and for the current limiter to release the clamp on the pass through device 104). The addition of the offset signal also has the effect of increasing T_NOM (i.e., the time duration for the output $V_{OUT}$ to ramp up to the nominal voltage $V_{NOM}$ due to a constant limited current. Accordingly, the addition of the offset signal has the effect of causing the time taken for the loop gain of the voltage regulation loop to reach a preset threshold to be less than the time taken for the output $V_{OUT}$ of the regulator 100 to reach the nominal operating voltage $V_{NOM}$.

In one implementation, as illustrated in the example of FIG. 3, an offset circuit 300 includes: a power source $V_{DD}$ arranged to produce an offset signal $i_{OFF}$, a switch 302 (such as the pass through devices described with reference to 104 and 108) arranged to combine the offset signal $i_{OFF}$ to a signal $V_{FB}$ at an input of the regulator 100, in response to an enable signal ($C_{LIM_ACTIVE}$); and a timing component (e.g., the current limiter 106, for example) arranged to send the enable signal ($C_{LIM_ACTIVE}$) to the switch 302 during a start-up of the voltage regulator 100. In an implementation, since the timing component (e.g., current limiter 106) sends the enable signal ($C_{LIM_ACTIVE}$) to the switch 302, the timing component determines when an offset signal (such as voltage $V_{OFF}$, for example) is added to the feedback voltage $V_{FB}$.

For instance, when the switch 302 receives the enable signal ($C_{LIM_ACTIVE}$) from the timing component, the switch 302 opens to combine an offset signal (e.g., $V_{OFF}$) with the feedback signal $V_{FB}$ at the voltage regulation loop of the regulator 100. In an alternate implementation, the switch 302 may be arranged to combine an offset signal $-V_{OFF}$ with the reference voltage $V_{REF}$ received at an input of the regulator 100. In that case, the offset signal may be an opposite polarity since it is being combined with the opposite differential input at the error amplifier 102. This has the same result as combining an offset signal $V_{OFF}$ with the feedback voltage $V_{FB}$.

In an implementation, the timing component (e.g., current limiter 106) is arranged to cease the enable signal ($C_{LIM_ACTIVE}$) to the switch 302 when at least two differential inputs (e.g., $V_{REF}$ and $V_{FB}$) to the voltage regulator 100 have substantially equal currents. In one example, the timing component is a current limiter 106, and the current limiter 106 is arranged to enable the addition of the offset voltage $V_{OFF}$ to the feedback voltage $V_{FB}$ upon commencement of the start-up of the regulator 100 and to disable the addition of the offset voltage $V_{OFF}$ to the feedback voltage $V_{FB}$ when the feedback voltage $V_{FB}$ reaches a preset minimum common mode potential. In another example, the current limiter 106 is arranged to enable the addition of the offset voltage $V_{OFF}$ to the feedback voltage $V_{FB}$ upon commencement of the start-up of the regulator 100 and to disable the addition of the offset voltage $V_{OFF}$ to the feedback voltage $V_{FB}$ when a loop gain of the voltage regulation loop reaches a preset threshold.

Figure 4:
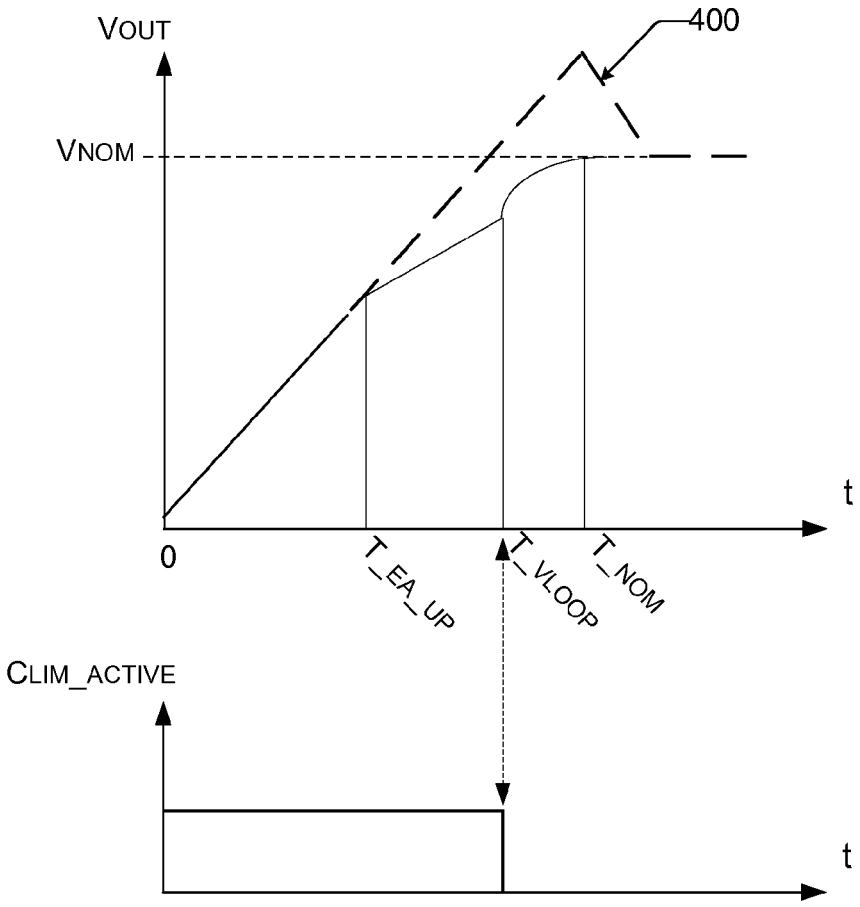
FIG. 4 is a graph showing an example start-up response of a regulator and offset circuit as shown in FIG. 3, according to an implementation.

Referring to FIG. 4, the upper graph shows an example start-up response ($V_{OUT}$) of a regulator 100 and offset circuit 300 as shown in FIG. 3, according to an implementation. The heavy dashed line 400 illustrates a voltage response at the output of the regulator 100 without overshoot correction. However, with the application of the techniques and devices disclosed, no overshoot is exhibited, as shown by the solid lines of the graph.

From time=0 to T_EA_UP, the constant current mode in the regulator 100 is active, as discussed above. $V_{OUT}$ is ramping towards $V_{BATT}$ from ground potential. Further, the error amplifier 102 is initially off and the voltage regulation loop is initially inactive. Once current begins to flow in the regulator 100, the feedback voltage can be expressed as:

$$V_{FB}=V_{OUT}/M+V_{OFF},$$

where M is the resistive voltage divider ratio. With the addition of the offset $V_{OFF}$, the feedback voltage $V_{FB}$ ramps up faster to a minimum common mode input potential for a minimum loop gain. Thus, the time T_EA_UP (the time for the voltage regulation loop to reach a minimum loop gain) is reduced.

From time=T_EA_UP to time=T_VLOOP, the error amplifier 102 is amplifying, so the voltage regulation loop reacts to bring down $V_{OUT}$ by the value of $V_{OFF}$. Thus, the voltage at $V_{OUT}$ is offset by $V_{OFF}$. The output of the regulator 100 can be expressed as:

$$V_{OUT}=(V_{REF}*ACl-V_{OFF}),$$

where ACl=Aol/1+M*Aol.

When Aol is large, ACl=1/M. Hence, $$V_{OUT}=V_{REF}*M-V_{OFF}.$$

The effect is that the ramping up of $V_{OUT}$ becomes slower (as shown in FIG. 4) and so T_NOM (the time for the regulator output $V_{OUT}$ to reach nominal voltage $V_{NOM}$) is increased. Aol is the open-loop gain and Acl is the closed-loop gain.

As mentioned above, the same results discussed here can be achieved by adding $-V_{OFF}$ to $V_{REF}$ at the $V_{REF}$ input of the error amplifier 102.

At time=T_VLOOP, the current clamp on the pass through device 104 is released. This is shown on the graph of FIG. 4 by the curve indicating an increase in output voltage to the nominal voltage $V_{NOM}$, from time=T_VLOOP to time=T_NOM. Since the duration T_NOM is greater than the duration T_VLOOP, there is no overshoot voltage at $V_{OUT}$.

Also at time=T_VLOOP, as shown in FIG. 4, the enable signal ($C_{LIM_ACTIVE}$) from the current limiter 106 goes low ("off"). This in turn removes the offset $V_{OFF}$ from being applied at the voltage regulation loop (or elsewhere).

Representative Processes

Figure 5:
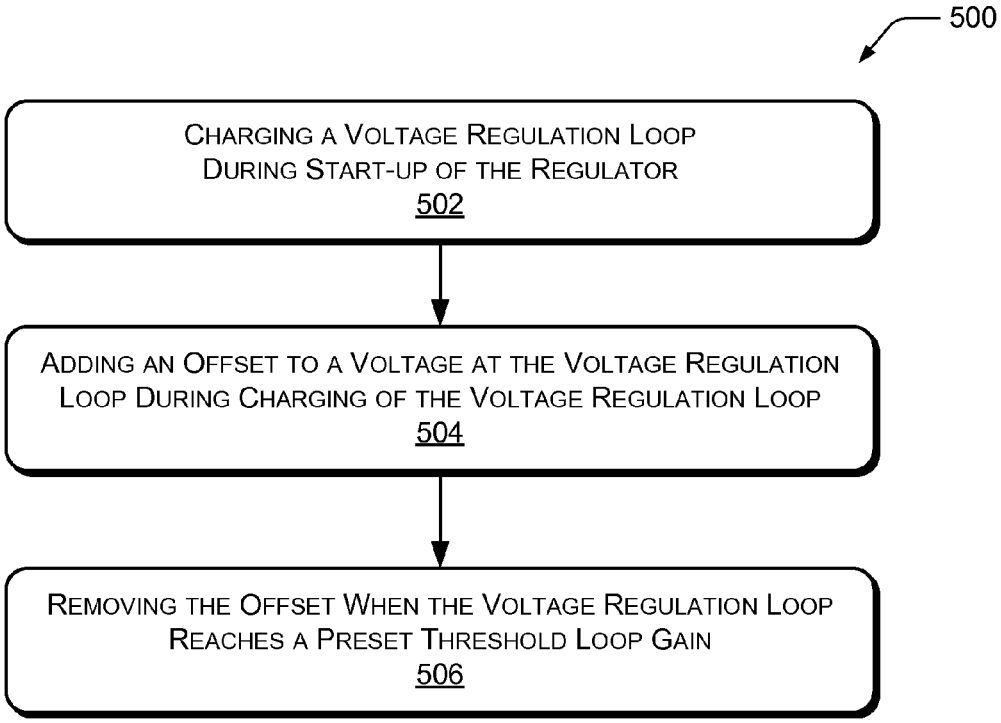
FIG. 5 is a flow diagram illustrating an example process of controlling overshoot at an output of a regulator according to an implementation

FIG. 5 illustrates a representative process 500 for controlling a voltage output of a regulator (such as the regulator 100). This includes implementing overshoot control techniques and/or devices at the regulator. An example process 500 includes determining when an offset is applied to one or more portions of the regulator circuit to reduce or eliminate the overshoot. In various implementations, the offset is applied upon commencement of start-up of the regulator and removed when a preset loop gain is achieved by the regulator. The process 500 is described with reference to FIGS. 1-4.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable hardware, software, firmware, or a combination thereof, without departing from the scope of the subject matter described herein.

At block 502, the process includes charging a voltage regulation loop during a start-up of the regulator (such as regulator 100). In various implementations, this includes charging other components of the regulator also such as a differential amplifier, one or more capacitors, one or more resistors, and the like.

For example, in one implementation, the process includes charging an error amplifier (such as error amplifier 102) of the regulator during start-up of the regulator. In another implementation, the process includes charging the regulator via a pass through device (such as pass through device 104). In one example, the pass through device is current limited during at least a portion of the start-up.

At block 504, the process includes adding an offset to a voltage at the voltage regulation loop during charging of the voltage regulation loop. Alternately, the process includes adding an offset to a current at the voltage regulation loop during charging. Further implementations include adding an offset to other portions of the regulator (e.g., a voltage or current reference input, one or more error amplifier inputs, etc.).

In one implementation, the process includes reducing a time duration for the voltage regulation loop to reach a preset minimum loop gain based on adding the offset to the voltage at the voltage regulation loop. In another implementation, the process includes reducing a time duration for the voltage regulation loop to reach a preset maximum loop gain based on adding the offset to the voltage at the voltage regulation loop.

In one implementation, the process includes increasing a time duration for an output of the voltage regulator to reach a preset nominal operating voltage based on adding the offset to the voltage at the voltage regulation loop. For example, in various implementations, an instantaneous value of the output of the voltage regulator is reduced based on adding the offset to the voltage at the voltage regulation loop.

At block 506, the process includes removing the offset when the voltage regulation loop reaches a preset threshold loop gain. In one implementation, the process includes charging the output of the voltage regulator to a preset nominal value after removing the offset.

In an implementation, a time duration for the voltage regulation loop to reach a preset minimum loop gain and a time duration for the voltage regulation loop to reach a preset maximum loop gain are less than a time duration for an output of the voltage regulator to reach a preset nominal operating voltage based on adding the offset to the voltage at the voltage regulation loop.

In alternate implementations, other techniques may be included in the process 500 in various combinations, and remain within the scope of the disclosure.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the invention.

What is claimed is:

1. A circuit arranged to control a voltage overshoot at a voltage regulator, comprising:

a power source arranged to produce an offset signal;

a switch arranged to combine the offset signal from the power source to a signal at an input of the voltage regulator in response to an enable signal;

a timing component arranged to send the enable signal to the switch during a start-up of the voltage regulator; and a voltage regulation loop having a loop gain, a duration for the loop gain to reach a preset threshold being less than a time duration for an output of the voltage regulator to reach a nominal operating voltage.

2. The circuit of claim 1, wherein the timing component is arranged to cease the enable signal to the switch when at least two differential inputs to the voltage regulator have substantially equal currents.

3. The circuit of claim 1, wherein the offset signal comprises at least one of an offset voltage and an offset current.

4. The circuit of claim 1, wherein the switch is arranged to combine the offset signal with a feedback voltage at a voltage regulation loop of the voltage regulator.

5. The circuit of claim 1, wherein the switch is arranged to combine the offset signal with a reference voltage received by the voltage regulator.

6. The circuit of claim 1, wherein the circuit is arranged to offset a voltage at an output of the voltage regulator.

7. A system, comprising:

a low drop out voltage regulator, including:

an error amplifier having a first input connected to a reference voltage and a second input connected to a feedback voltage, an output of the voltage regulator being based on the reference voltage and the feedback voltage; and a voltage regulation loop coupled to the second input of the error amplifier and arranged to provide the feedback voltage; and an offset circuit arranged to add an offset voltage to the feedback voltage during at least a portion of a start-up of the voltage regulator, wherein a time duration for a loop gain of the voltage regulation loop to reach a preset threshold is less than a time duration for an output of the voltage regulator to reach a nominal operating voltage.

8. The system of claim 7, further comprising a current limiter arranged to determine a current flow through the voltage regulator during at least a portion of the start-up of the voltage regulator and to determine when the offset voltage is added to the feedback voltage.

9. The system of claim 8, wherein the current limiter is arranged to enable the addition of the offset voltage to the feedback voltage upon commencement of the start-up of the voltage regulator and to disable the addition of the offset voltage to the feedback voltage when the feedback voltage reaches a preset minimum common mode potential.

10. The system of claim 8, wherein the current limiter is arranged to enable the addition of the offset voltage to the feedback voltage upon commencement of the start-up of the voltage regulator and to disable the addition of the offset voltage to the feedback voltage when the loop gain of the voltage regulation loop reaches a the preset threshold.

11. A method of controlling a voltage output of a voltage regulator, comprising:

charging a voltage regulation loop during a start-up of the voltage regulator;

adding an offset to a voltage at the voltage regulation loop during charging of the voltage regulation loop;

removing the offset when the voltage regulation loop reaches a preset threshold loop gain; and reducing a time duration for the voltage regulation loop to reach a preset minimum loop gain based on adding the offset to the voltage at the voltage regulation loop.

12. The method of claim 11, further comprising charging an error amplifier of the voltage regulator during start-up of the voltage regulator and adding the offset voltage to a voltage at an input of the error amplifier while charging the error amplifier.

13. The method of claim 11, further comprising charging the voltage regulator via a pass through device, wherein the pass through device is current limited during at least a portion of the start-up.

14. The method of claim 11, further comprising charging the output of the voltage regulator to a preset nominal value after removing the offset.

15. The method of claim 11, further comprising reducing a time duration for the voltage regulation loop to reach a preset maximum loop gain based on adding the offset to the voltage at the voltage regulation loop.

16. The method of claim 11, further comprising increasing a time duration for an output of the voltage regulator to reach a preset nominal operating voltage based on adding the offset to the voltage at the voltage regulation loop.

17. The method of claim 11, wherein an instantaneous value of the output of the voltage regulator is reduced based on adding the offset to the voltage at the voltage regulation loop.

18. The method of claim 11, wherein a time duration for the voltage regulation loop to reach a preset minimum loop gain and a time duration for the voltage regulation loop to reach a preset maximum loop gain are less than a time duration for an output of the voltage regulator to reach a preset nominal operating voltage based on adding the offset to the voltage at the voltage regulation loop.

19. A low dropout voltage regulator, comprising:

an error amplifier having at least a first input and a second input;

a voltage regulation loop coupled to the first input of the error amplifier; and an offset circuit arranged to provide an offset value to at least one of the first input and the second input of the error amplifier during at least a portion of a start-up of the voltage regulator, wherein the voltage regulation loop includes a loop gain, a duration for the loop gain to reach a preset threshold being less than a time duration for an output of the voltage regulator to reach a nominal operating voltage.

20. The low dropout voltage regulator of claim 19, further comprising a reference voltage coupled to the second input of the error amplifier, and wherein the offset circuit is arranged to provide the offset value to the voltage regulation loop while a voltage at the first input of the error amplifier is less than the reference voltage.

21. The low dropout voltage regulator of claim 19, wherein the offset circuit is arranged to combine the offset value to the reference voltage at the second input of the error amplifier while a voltage at the first input of the error amplifier is less than a voltage at the second input of the error amplifier.

22. The low dropout voltage regulator of claim 19, wherein the offset circuit is arranged to provide the offset value to the at least one of the first input and the second input of the error amplifier until the voltage regulation loop reaches a preset threshold loop gain.

* * * * *